US005301721A

United States Patent [19]

Hartmann

[11] Patent Number: 5,301,721

[45] Date of Patent: Apr. 12, 1994

[54] UNDERGROUND SECONDARY CONTAINMENT AND VAPOR RECOVERY PIPING SYSTEM

[76] Inventor: John P. Hartmann, 509 Lake Shore Dr. N., Barrington, Ill. 60010

[21] Appl. No.: 46,362

[22] Filed: Apr. 8, 1993

Related U.S. Application Data

[63] Continuation of Ser. No. 528,687, May 24, 1990, abandoned.

[51] Int. Cl.[5] ..... B67D 5/00

[52] U.S. Cl. ..... 141/59; 141/45; 141/86; 141/290; 137/312; 137/372; 73/40.5 R; 73/49.1; 285/133.1; 138/114; 138/121

[58] Field of Search ..... 141/44, 45, 59-61, 141/285, 286, 290, 392, 301-308, 86, 389; 220/85 F, 85 S, 85 VR, 85 VS, 86 R; 137/234.6, 363, 364, 312, 314, 372; 285/133.1; 138/114, 121, 220; 128/911; 73/40.5 R, 40, 49.1

[56] References Cited

U.S. PATENT DOCUMENTS

| | | | |
|---|---|---|---|
| 1,454,971 | 5/1923 | Love | 220/86 R |
| 2,149,602 | 3/1939 | Horvath | 137/363 |
| 2,569,110 | 9/1951 | McGillis et al. | 137/65 |
| 2,649,769 | 8/1953 | Kaiser | 137/372 |
| 2,658,527 | 11/1953 | Kaiser | 285/133.1 |
| 2,932,257 | 6/1960 | Webb | 285/133.1 X |
| 2,952,390 | 9/1960 | Fowler et al. | 73/40 |
| 3,011,829 | 12/1961 | Wiseman | 222/146.6 |
| 3,016,928 | 1/1962 | Brandt | 141/290 |
| 3,183,723 | 5/1965 | Deters | 73/40.5 R |
| 3,732,902 | 5/1973 | Muller | 141/303 X |
| 3,814,148 | 6/1974 | Wostl | 137/234.6 X |
| 3,926,230 | 12/1975 | Stary et al. | 141/45 |
| 4,009,739 | 3/1977 | Weatherford | 141/59 |
| 4,010,779 | 3/1977 | Pollock et al. | 141/44 |
| 4,058,147 | 11/1977 | Stary et al. | 141/45 |
| 4,094,346 | 6/1978 | Milo | 141/286 |
| 4,098,308 | 7/1978 | Purdum | 141/285 |
| 4,310,033 | 1/1982 | Deters | 141/44 |
| 4,333,451 | 6/1982 | Paluch | 128/911 X |
| 4,566,504 | 1/1986 | Furrow et al. | 141/59 |
| 4,570,686 | 2/1986 | Devine | 141/286 |
| 4,615,362 | 10/1986 | Hartman et al. | 141/86 |
| 4,667,505 | 5/1987 | Sharp | 285/133.1 |
| 4,796,676 | 1/1989 | Hendershot et al. | 141/98 X |
| 4,805,444 | 2/1989 | Webb | 73/40.5 R |
| 4,896,705 | 1/1990 | Podgers et al. | 141/86 |
| 4,926,899 | 5/1990 | Argandona | 137/312 X |
| 4,967,809 | 11/1990 | Faeth | 141/59 |
| 4,971,477 | 11/1990 | Webb et al. | 138/114 X |
| 5,040,577 | 8/1991 | Pope | 141/59 |

FOREIGN PATENT DOCUMENTS

| | | | |
|---|---|---|---|
| 0343884 | 11/1989 | European Pat. Off. | 141/285 |
| 1425489 | 5/1969 | Fed. Rep. of Germany | 285/133.1 |

*Primary Examiner*—J. Casimer Jacyna
*Attorney, Agent, or Firm*—Thomas R. Vigil

[57] ABSTRACT

The underground secondary containment and simultaneous vapor return piping system is adapted for use at a fuel service station which includes a fuel dispenser, a fuel nozzle and nozzle vapor return structure at a dispensing island, an underground fuel storage tank and a primary fuel delivery pipeline. The system comprises an outer, underground, sealed, larger diameter, secondary containment/vapor return pipeline extending around and axially with the inner, primary fuel delivery pipeline from the underground storage tank to the fuel dispenser to establish secondary containment for the fuel delivery pipeline and simultaneously to establish within the secondary containment/vapor return pipeline and around or about the fuel delivery pipeline, a continuous, uninterrupted, axially extending, interstitial space defining a vapor return path, upper fluid coupling termination structure for coupling (a) the interstitial space within the outer secondary containment/vapor return pipeline to the nozzle vapor return structure and (b) the fuel delivery pipeline to the fuel dispenser nozzle, and lower fluid coupling termination structure for coupling (a) the interstitial space within the outer secondary containment/vapor return pipeline to the first, vapor return opening in a wall of the underground storage tank and (b) the fuel delivery pipeline to the second, fuel outlet opening in a wall of the underground storage tank whereby a continuous uninterrupted, vapor return space or path, in addition to secondary containment, is established in and by the secondary containment/vapor return pipeline, between the upper and lower fluid coupling termination structures and around or about the fuel delivery pipeline.

6 Claims, 3 Drawing Sheets

UNDERGROUND SECONDARY CONTAINMENT AND VAPOR RECOVERY PIPING SYSTEM

This is a continuation of application Ser. No. 07/528,687 filed May 24, 1990 now abandoned.

BACKGROUND OF THE INVENTION

1. Field of the Invention.

The present invention relates to a vapor return piping system for a fuel storage and delivery system such as typically found at a gasoline service station. More specifically, the present invention is directed to the provision of an outer, larger diameter secondary containment piping system about an inner, primary fuel delivery piping system and to the utilization of the intersticial space between the inner primary fuel delivery piping system and the outer secondary containment piping system for the return of fuel vapor to an underground storage tank.

2. Description of the related art including information disclosed under 37 CFR Sections 1.97–1.99.

Over the last 40 years, there has been an increasing concern about contamination of the environment, including land, sea and air, with petroleum products, such as gasoline fuel utilized in internal combustion engines in vehicles. Thus, over the last 40 years laws, rules and regulations have been promulgated by state and federal governmental bodies prohibiting contamination of the environment with petroleum products such as gasoline.

In view of these laws, rules and regulations, techniques and systems have been developed for minimizing the escape of gasoline from underground storage tanks into adjacent soil or water and for minimizing the escape of gasoline vapor into the air when delivering gasoline to the storage tank or from the storage tank to a vehicle fuel tank.

With respect to the prevention of soil and water pollution, a number of states require that a gasoline storage tank have secondary containment, namely, a double wall or secondary outer wall around the inner, primary wall of the gasoline storage tank. Also, it is required that piping which normally contains fuel be double layered or have a secondary containment barrier around and about the piping from the storage tank to prevent escape of fuel to and into the ambient environment.

With respect to preventing pollution of the air with gasoline vapor, gasoline vapor return lines have been proposed inside or in conjunction with the piping to and from the underground storage tank.

For example, the Brandt U.S. Pat. No. 3,016,928 discloses a device for extracting fumes from liquid fuel storage containers. The device includes a vapor escape line that extends within an output pipe from an underground storage tank to a pumping island and through a delivery hose and outlet nozzle. Fumes generated by the escape of gasoline from the nozzle outlet to a vehicle fuel tank are returned to the underground storage tank. The tank has a lower pressure in the space above the gasoline in the tank as a result of the drop in liquid level in the tank as gasoline is pumped from the tank, i.e. a drop in head pressure.

This patent also proposes a vapor return line in the tubing or hose extending from the inside of a tank truck to an outlet of the hose placed within the storage tank after a distal end portion of the hose is inserted through a storage tank fill pipe for filling the underground storage tank with gasoline.

In the Mayer U.S. Pat. No. 4,100,758, there is disclosed a vacuum assist fuel system which includes a vapor return conduit which extends from a dispensing nozzle to and through the top wall of an underground fuel storage tank. A valve is provided in this conduit to control vapor flow through the conduit back to the storage tank only when gasoline is being dispensed.

Examples of other prior art patents which disclose separate vapor return lines or conduits to an underground storage tank are listed below:

| U.S. Pat. No. | Patentee |
|---|---|
| 3,672,180 | Davis |
| 3,863,687 | Alquist |
| 3,907,010 | Burtis, et al. |
| 4,009,985 | Hirt |
| 4,010,779 | Pollock, et al. |
| 4,018,252 | Burtis, et al. |
| 4,566,504 | Furrow, et al. |

The Davis U.S. Pat. No. 3,672,180, the Alquist U.S. Pat. No. 3,863,687 and the Pollock et al. U.S. Pat. No. 4,010,779 also teach the provision of a condenser in the vapor return path, such as on the gasoline dispensing island at the gasoline service station, whereby the vapor is first condensed and then returned as a liquid to the underground storage tank.

With respect to protection of soil and water by secondary containment of the underground storage tank from leakage of gasoline from the storage tank, it has been proposed by Total Containment, Inc. of Exton, Pa. to provide a jacketed steel tank having a 100 mil thick high density polyethylene jacket around a U.L.58 steel underground storage tank.

Further, in the Webb U.S. Pat. No. 4,805,444, assigned to Total Containment Inc., there is disclosed a secondary containment system comprising telescoping pipe sections of different diameters installed around a primary pipeline between a gasoline dispensing island at a gasoline service station and an underground storage tank.

Also, general information on underground liquid storage systems can be found in:

1. The Petroleum Equipment Institute publication No. PEI/RP100-87 entitled: "Recommended Practices for Installation of Underground Liquid Storage Systems"; and 2. The American Petroleum Institute API Recommended Practice 1615, Fourth Edition, November 1987 entitled: "Installation of Underground Petroleum Storage Systems."

As will be described in greater detail hereinafter, the vapor return piping system of the present invention provides an improvement over the prior art, separate vapor return pipeline systems referred to above by providing an outer, larger diameter piping system including piping mounted about a smaller diameter fuel delivery pipeline or piping system with a continuous axially extending space established within the piping about the fuel delivery pipeline, and utilizing the continuous space for a vapor return path.

The piping can be clear plastic secondary containment pipe of the type sold by R & G Sloane Manufacturing Co., Inc. of Sun Valley, Calif., or similar pipe sold by Occidental Petroleum, Total Containment, Containment Technologies, Red Thread Smith-Inland, or Omnicron.

The vapor return piping system also includes a connection or termination at the proximal end of the outer piping system to a vapor return opening in an underground storage tank, and a connection or termination at or adjacent the distal end of the outer piping system to a vapor return hose or tubing connected to a gasoline dispensing nozzle.

SUMMARY OF THE INVENTION

According to the present invention there is provided an underground secondary containment and simultaneous vapor return piping system adapted for use at a fuel service station which includes a fuel dispenser including a fuel dispensing nozzle and nozzle vapor return structure at a dispensing island, an underground fuel storage tank having a first, vapor return opening in a wall of the tank and a second, fuel outlet opening in a wall of the tank and a primary fuel delivery pipeline having a given diameter and extending between the underground storage tank and the fuel dispenser. The secondary containment and simultaneous vapor return piping system comprises an outer, underground, sealed, larger diameter, secondary containment/vapor return pipeline extending around and axially with the inner, primary fuel delivery pipeline from the underground storage tank to the fuel dispenser to establish secondary containment for the fuel delivery pipeline and simultaneously to establish within the secondary containment-/vapor return pipeline and around or about the fuel delivery pipeline, a continuous, uninterrupted, axially extending, interstitial space defining a vapor return path, upper fluid coupling termination structure for coupling (a) the interstitial space within the outer secondary containment/vapor return pipeline to the nozzle vapor return structure and (b) the fuel delivery pipeline to the fuel dispenser nozzle, and lower fluid coupling termination structure for coupling (a) the interstitial space within the outer secondary containment/vapor return pipeline to the first, vapor return opening in a wall of the underground storage tank and (b) the fuel delivery pipeline to the second, fuel outlet opening in a wall of the underground storage tank whereby a continuous uninterrupted, vapor return space or path, in addition to secondary containment, is established in and by the secondary containment/vapor return pipeline, between the upper and lower fluid coupling termination structures and around or about the fuel delivery pipeline. The lower fluid coupling termination structure includes a valve for preventing fuel from entering the secondary containment/vapor return pipeline from the underground storage tank. The primary fuel delivery pipeline together with the secondary containment/vapor return pipeline are arranged to slope downwardly at a selected slope angle from the dispensing island to the underground storage tank.

Preferably, the primary fuel delivery pipeline has a flexible portion at least adjacent to or as part of the lower fluid coupling termination structure and the secondary containment/vapor return pipeline also has a flexible portion at least in the area surrounding the flexible portion of the primary fuel delivery pipeline.

In one preferred embodiment, a sensor for sensing fuel is mounted to the lower side of the outer secondary containment/vapor return pipeline adjacent the lower fluid coupling termination structure and an annunciator, for sounding an alarm indicating an accumulation of fuel in the outer secondary containment/vapor return pipeline, is located at the fuel station and is connected by conductors to the sensor.

DESCRIPTION OF THE PREFERRED EMBODIMENT(S)

Figure 1:
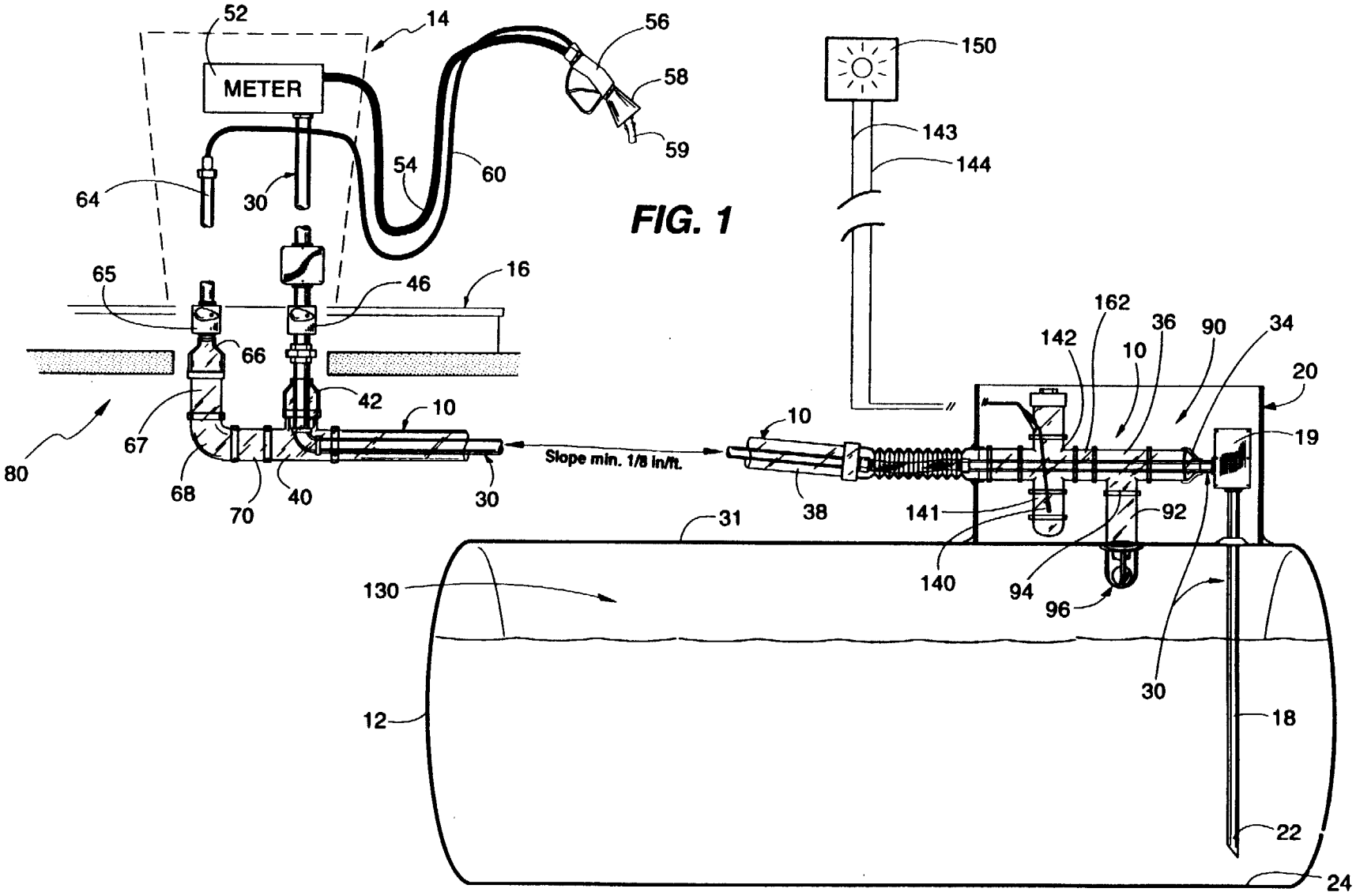
FIG. 1 is a schematic, elevational view with portions broken away of the vapor return piping system of the present invention.
Figure 2:
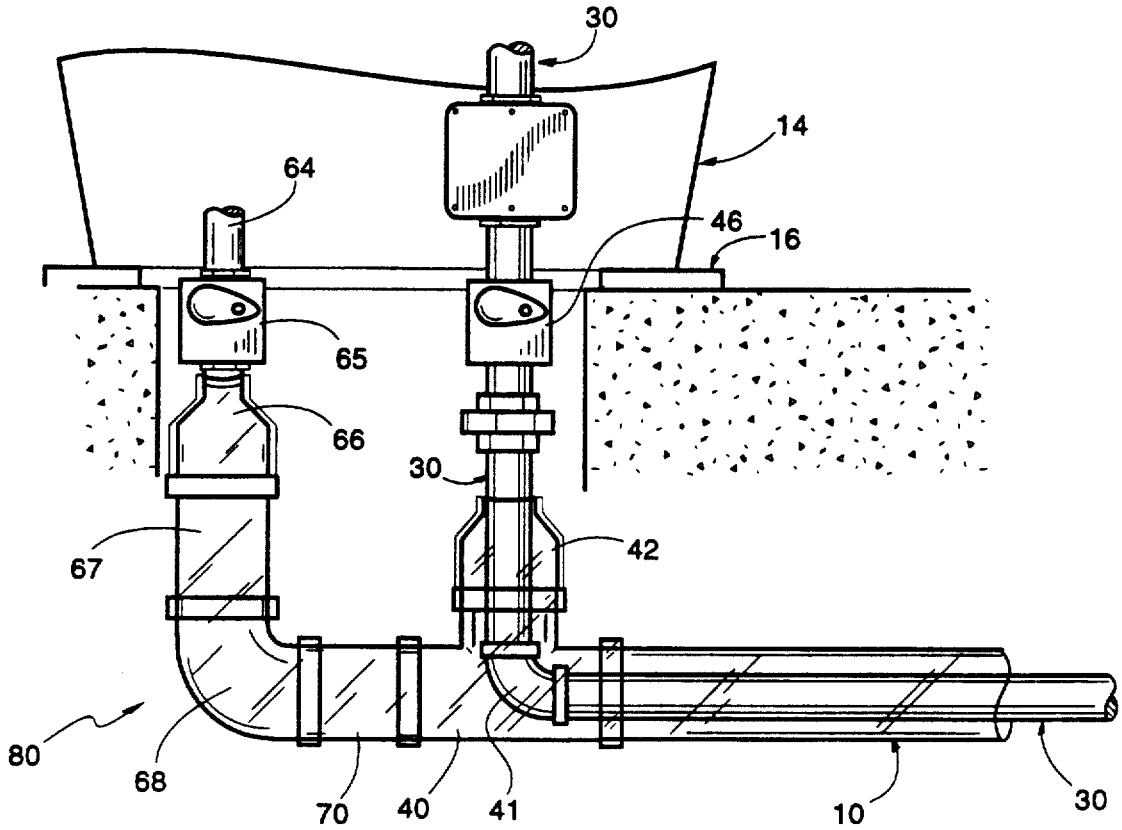
FIG. 2 is a fragmentary enlarged elevational view, with portions broken away of the upper or distal termination of the vapor return piping system shown in FIG. 1.

Referring now to the drawings in greater detail, there is illustrated in FIG. 1 a schematic, elevational view, with portions broken away, of a vapor return pipeline or piping system 10 which is constructed according to the teachings of the present invention and which is installed between an underground storage tank 12 and a gasoline dispenser 14 mounted at a dispenser island 16 at a gasoline service station.

As shown, a pipe 18 extends into the tank 12 from a pump 19 in a sump housing 20. This pipe 18 is shown extending directly into the liquid in the tank 12 and opens at a lower end 22 a short distance above a bottom wall 24 of the tank 12.

The pipe 18 is part of the pump 19 for pumping fuel, such as gasoline, from the tank 12 through the pipe 18 and forms part of a fuel delivery pipeline or piping system 30 which extends from the pump 19 out of the sump housing 20.

The pipe 18 extends upwardly through an upper wall 31 of the tank 12 to the pump 19 located in the sump housing 20. From there the pipeline 30 extends into a reducer 34, a tee 36 and a larger diameter pipe section 38 of the vapor return piping system 10 which encircles the fuel delivery pipeline 30.

The encircling vapor return piping system 10 also can and usually does, function as a secondary containment for the fuel delivery pipeline 30 and extends with the pipeline 30 upwardly at a slight slope of ¼" per foot to a tee 40.

The concentric pipelines 10 and 30 then extend together upwardly with the pipeline 30 extending into the island 16 for connection to the gasoline dispenser 14.

As shown, the fuel delivery pipeline 30 extends upwardly from an elbow 41 through a reducer 42 of the pipeline 30 and through a fire protection valve 46 to a flow meter 52 which can include a pump, if desired.

A flexible hose 54 is connected to an outlet of the flow meter 52 and extends to a hand operated dispensing nozzle 56 which can be of the type disclosed in the Mayer U.S. Pat. No. 4,100,758. The nozzle 56 includes a resilient walled boot 58 which engages against the upper annular edge of a vehicle fill pipe (not shown) and which defines an annular passage about a gasoline dispensing spout 59 of the nozzle 56 within the boot 58.

The annular passage provides a vapor return path to a vapor return hose 60 extending back from the nozzle 56 to the gasoline dispenser 14.

At the gasoline dispenser 14, a proximal end 62 of the vapor return hose 60 is connected to a vapor pipe 64 which extends through a fire protection valve 65 to a reducer 66 which in turn is connected by a short pipe section 67 to a large diameter elbow 68 that in turn is connected by a short pipe section 70 to the tee 40.

The construction defined above defines an upper or distal termination assembly 80 of the vapor return pipeline 10.

Figure 3:
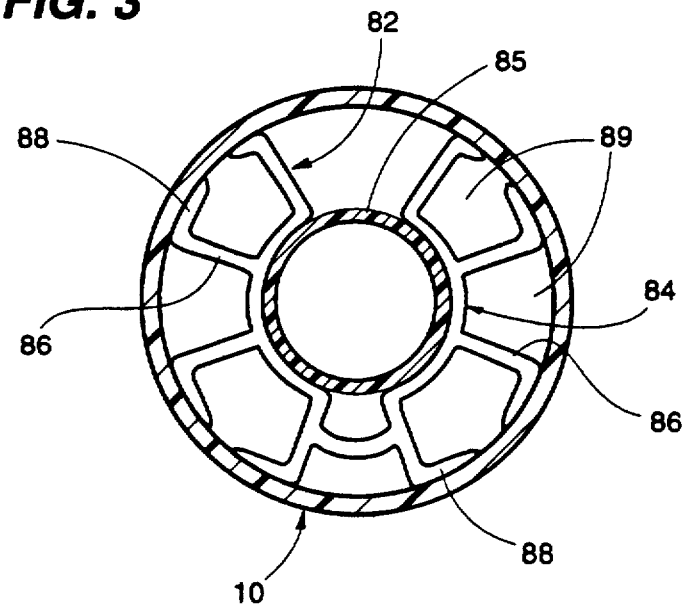
FIG. 3 is taken along line 3—3 of FIG. 2, is a sectional view through a pipe section of the vapor return piping system, and shows a cross section of a spacer element which can be positioned in the annular space between an internal fuel delivery pipe section and the outer vapor return pipe section.

The outer, larger diameter piping system 10 can be made of plastic piping, such as clear plastic piping. One piping of this type is sold by R & G Sloan Manufacturing Co., Inc. of Sun Valley, Calif., under the trade description CONTAINIT SECONDARY CONTAINMENT PIPING SYSTEM. This type of piping includes spacer elements, such as the spacer element 82 shown in FIG. 3, which includes a C-shaped inner partial ring 84 which is received around a pipe section 85 of the fuel delivery pipeline 30 and a plurality of outwardly extending arms 86 which terminate in arcuate flanges 88 which seat against the inner surface of the outer, larger diameter sections of the pipeline 10.

The spacer elements 82 within the pipe sections, e.g. pipe sections 36 and 38, of the vapor return piping system 10 have open spaces between the arms 84 whereby a continuous passageway or space 89 is defined within the vapor return piping system 10 around the pipeline 30 from the upper termination assembly 80 to a lower or proximal terminal assembly 90 defined by the reducer 34, a short pipe section 91, the tee 36, and a short pipe section 92 extending from a side port 94 of the tee 36 downwardly to a valve assembly 96 mounted in the tank 12 at an opening 98 (FIG. 4) through then upper wall 31 of the tank 12. Spacers 82 also can be provided in reducers 34 and 42.

According to the teachings of the present invention, the continuous space or passageway 89 is utilized as a vapor return path from the upper termination assembly 80 connected to the vapor return hose 60 to the lower termination assembly 90, connected to the vapor return opening 98 in the upper wall 31 of the tank 12 located in the sump housing 20.

The short pipe section 92 extends downwardly to the upper wall 31 of the underground storage tank 12 and around the vapor opening 98 therein. The valve assembly 96 is mounted within the tank 12 adjacent the upper wall 31 thereof and about the vapor return forming opening 98 as shown in FIG. 4.

Figure 4:
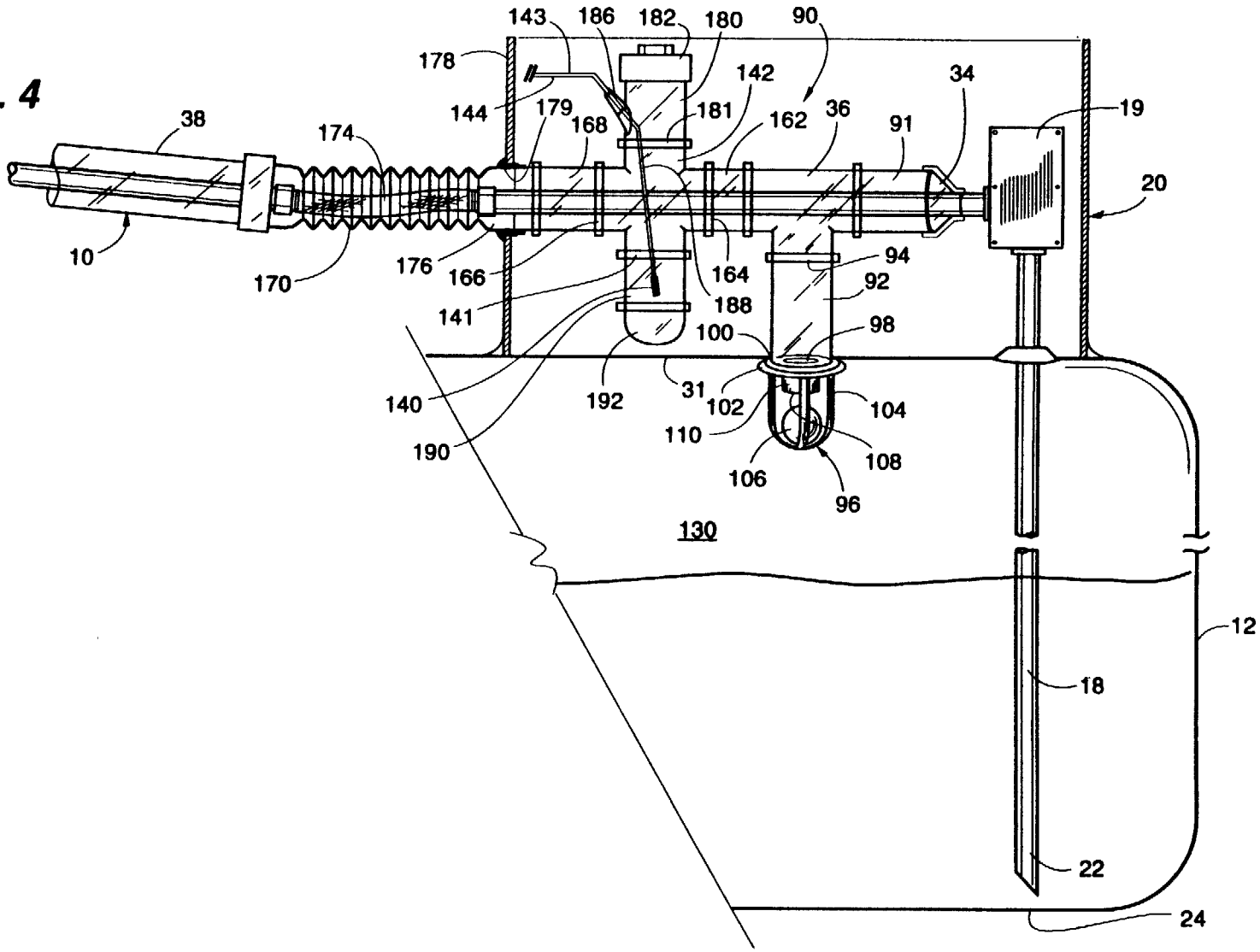
FIG. 4 is a fragmentary, enlarged, elevational view with portions broken away of a proximal or lower end termination of the vapor return piping system shown in FIG. 1.

As shown in FIG. 4, the valve assembly 96 mounted within and adjacent the upper wall 31 of the underground storage tank 12 can be of the type which includes an annular flange 100, that is mounted on the outside of the upper wall 31 adjacent the vapor return opening 98 in the upper wall 31 of the tank 12. Then another annular flange 102 is mounted within the tank 12 adjacent the upper wall 31 and around the vapor return opening. A cage 104 depends from the inner annular flange 102 and has a ball shaped float 106 received therein and disposed adjacent a lower portion of the cage 104 below a lower outlet opening 108 in a short tube 110 extending downwardly from the inner annular flange 102 around the vapor return opening 98.

The ball shaped float 106 prevents the escape of gasoline into the outer, larger diameter piping system 10. In this respect, as the level of fuel or gasoline in the tank 12 rises to the point where it engages the ball shaped float 106, the float 106 rises upwardly and seats against the lower end 108 of the short tube 110 to close off the vapor return path through the outer larger outer diameter piping system 10.

With the vapor return piping system 10 described above, including the upper or distal termination assembly 80 and the lower or proximal termination assembly 90, vapor generated during the dispensing of fuel from the dispensing nozzle 56 is returned in a simple and efficient manner to the underground storage tank 12 via the upper termination assembly 80, the annular space 89 within the outer, larger outer diameter pipeline 10 and the lower termination assembly 90.

It will be understood that as gasoline fuel is pumped from the underground storage tank 12, the level of the gasoline in the tank 12 will fall, creating a drop in the "head" pressure in the tank 12. In other words, a vacuum is created in the space 130 (FIG. 4) in the tank 12 above the gasoline. This vacuum or lower head pressure serves to suck the gasoline vapors back into the tank 12 during the dispensing of gasoline from the gasoline nozzle 56.

If desired, a pump assist system for assisting in the pumping of the gasoline vapors back to the storage tank 12 can be utilized which is driven by the flow of gasoline being delivered to a vehicle fuel tank. Such a pump assist system can be of the type disclosed in the Brandt U.S. Pat. No. 3,016,928 which includes a paddle wheel driven pump in a gasoline delivery line and a fan type vapor pump in a vapor return line.

It also will be appreciated that the outer, larger diameter piping system 10 can, and very likely will, serve as a secondary containment for the fuel delivery pipeline 30.

If desired, and as shown in FIGS. 1 and 4, a liquid fuel sensor 140 can be mounted beneath a lower port 141 of a four way connector or cross fitting 142 of the piping system 10, a short distance upstream from the tee 36 before the piping system 10 slopes upwardly at a slope of ⅛" per foot as shown in FIG. 1. The sensor 140 will sense any large accumulation of liquid fuel, e.g., gasoline, that may accumulate at the sensor 140, indicating a large condensation of gasoline vapor within the outer, larger diameter piping system 10, or, what is more important, a leak in the fuel delivery pipeline 30 mounted within outer, larger diameter, vapor return, piping system 10.

As shown in FIGS. 1 and 4, wire conductors 143, 144 extend from the sensor 140 to an annunciator 150, which can be a flashing light or audible alarm, which is typically located in the service station building.

As best shown in FIG. 4, the reducer 34 is connected to the short pipe section 91 that is connected to the tee 36 which has the side port 94 connected to the vapor return opening 98 in the upper wall 38 of the tank 12. The tee 36 is then connected via a short pipe section 162 to a port 164 of the cross fitting 142. An in-line port 166 of the cross fitting 142 is then connected by a short pipe section 168 to a flexible tubular coupling 170 which connects to the piping section 38 of the pipeline 10 that extends upwardly at a slope. Also, spacers 82 can be provided in pipe sections 91, 162 and 168.

Here it will be seen that a flexible tubing 174 of the fuel delivery pipeline 31 is situated within the flexible tubular coupling 170. As shown, one end 176 of the coupling is fixed to a wall 178 of the sump housing 20 within an opening 179 in the sump housing.

The sump housing 20 is open at the top and a short section of pipe 180 extends upwardly from a port 181 which is in-line with the port 141. A cap 182 closes off the top end of the short pipe section 180 and the open top provides easy access to the cap 182.

In the illustrated embodiment, a sealed cable sensor port 186 is provided in the short pipe section 180 and has a probe 188 extending downwardly therefrom to the sensor 140 mounted at the lower end thereof.

As shown, a short pipe section 190 extends downwardly from the lower port 141 to a liquid collection bowl 192 fixed to the lower end of the pipe section 190. The sensor 140 is situated in the short pipe section 190 above the bottom of the bowl 192 so that the sensor will not sense liquid fuel until a significant amount of liquid fuel has collected in the bowl 192 and the pipe section 190 which form a drip leg.

From the foregoing description, it will be apparent that the vapor return piping system 10 of the present invention has a number of advantages, some of which have been described above and others of which are inherent in the invention. For example, the piping system 10 provides a simple and efficient means for returning vapor to an underground storage tank while at the same time providing secondary containment for the fuel delivery pipeline 30 and facilitating the detection of leaks.

Furthermore, a separate vapor return pipeline 10 to each tank of several tanks at a service station allows for elimination of manifolds between tank vents which would be required if vapor return lines are combined. In the piping system 10, vapor goes back to the same tank from which the fuel is pumped.

Also, it will be apparent that modifications can be made to the vapor return piping system 10 without departing from the teachings of the invention. Accordingly, the scope of the invention is only to be limited as necessitated by the accompanying claims.

I claim:

1. An underground secondary containment and simultaneous vapor return piping system for use at a fuel service station which includes a fuel dispenser including a fuel dispensing nozzle and nozzle vapor return means at a dispensing island, an underground fuel storage tank having a first, vapor return opening in a wall of the tank and a second, fuel outlet opening in a wall of the tank, and a primary fuel delivery pipeline having a given diameter and extending between the underground storage tank and the fuel dispenser, said secondary containment and simultaneous vapor return piping system comprising an outer, underground, sealed, larger diameter, secondary containment/vapor return pipeline extending around and axially with the inner, primary fuel delivery pipeline from the underground storage tank to the fuel dispenser to establish secondary containment for said fuel delivery pipeline and simultaneously to establish within the secondary containment/vapor return pipeline and around or about said fuel delivery pipeline, a continuous, uninterrupted, axially extending, interstitial space defining a vapor return path, upper fluid coupling termination means for coupling (a) the interstitial space within said outer secondary containment/vapor return pipeline to the nozzle vapor return means and (b) the fuel delivery pipeline to the fuel dispenser nozzle, and lower fluid coupling termination means for coupling (a) the interstitial space within said outer secondary containment/vapor return pipeline to the first, vapor return opening in a wall of the underground storage tank and (b) the fuel delivery pipeline to the second, fuel outlet opening in a wall of the underground storage tank whereby a continuous uninterrupted, vapor return space or path, in addition to secondary containment, is established in and by said secondary containment/vapor return pipeline, between said upper and lower fluid coupling termination means and around or about said fuel delivery pipeline, said primary fuel delivery pipeline having a flexible portion at least adjacent to or as part of said lower fluid coupling termination means and said secondary containment/vapor return pipeline also having a flexible portion at least in the area surrounding said flexible portion of said primary fuel delivery pipeline, said lower fluid coupling termination means including valve means for preventing fuel from entering said secondary containment/vapor return pipeline from the underground storage tank and said primary fuel delivery pipeline together with said secondary containment/vapor return pipeline being arranged to slope downwardly at a selected slope angle from the dispensing island to the underground storage tank.

2. An underground secondary containment and simultaneous vapor return piping system for use at a fuel service station which includes a fuel dispenser including a fuel dispensing nozzle and nozzle vapor return means at a dispensing island, an underground fuel storage tank having a first, vapor return opening in a wall of the tank and a second, fuel outlet opening in a wall of the tank, and a primary fuel delivery pipeline having a given diameter and extending between the underground storage tank and the fuel dispenser, said secondary containment and simultaneous vapor return piping system comprising an outer, underground, sealed, larger diameter, secondary containment/vapor return pipeline extending around and axially with the inner, primary fuel delivery pipeline from the underground storage tank to the fuel dispenser to establish secondary containment for said fuel delivery pipeline and simultaneously to establish within the secondary containment/vapor return pipeline and around or about said fuel delivery pipeline, a continuous, uninterrupted, axially extending, interstitial space defining a vapor return path, upper fluid coupling termination means for coupling (a) the interstitial space within said outer secondary containment/vapor return pipeline to the nozzle vapor return means and (b) the fuel delivery pipeline to the fuel dispenser nozzle, lower fluid coupling termination means for coupling (a) the interstitial space within said outer secondary containment/vapor return pipeline to the first, vapor return opening in a wall of the underground storage tank and (b) the fuel delivery pipeline to the second, fuel outlet opening in a wall of the underground storage tank whereby a continuous uninterrupted, vapor return space or path, in addition to secondary containment, is established in and by said secondary containment/vapor return pipeline, between said upper and lower fluid coupling termination means and around or about said fuel delivery pipeline, said primary fuel delivery pipeline having a flexible portion at least adjacent to or as part of said lower fluid coupling termination means and said secondary containment/vapor return pipeline also having a flexible portion at least in the area surrounding said flexible portion of said primary fuel delivery pipeline, said lower fluid coupling termination means including valve means for preventing fuel from entering said secondary containment/vapor return pipeline from the underground storage tank and said primary fuel delivery pipeline together with said secondary containment/vapor return pipeline being arranged to slope downwardly at a selected slope angle from the dispensing island to the underground storage tank and, at least a portion of said lower fluid coupling termination means being mounted in a covered sump housing mounted to the upper wall of the underground storage tank.

3. An underground secondary containment and simultaneous vapor return piping system for use at a fuel service station which includes a fuel dispenser including a fuel dispensing nozzle and nozzle vapor return means at a dispensing island, an underground fuel storage tank having a first, vapor return opening in a wall of the tank and a second, fuel outlet opening in a wall of the tank, and a primary fuel delivery pipeline having a given diameter and extending between the underground storage tank and the fuel dispenser, said secondary containment and simultaneous vapor return piping system comprising an outer, underground, sealed, larger diameter, secondary containment/vapor return pipeline extending around and axially with the inner, primary fuel delivery pipeline from the underground storage tank to the fuel dispenser secondary containment for said fuel delivery pipeline and simultaneously to establish within the secondary containment/vapor return pipeline and around or about said fuel delivery pipeline, a continuous, uninterrupted, axially extending, interstitial space defining a vapor return path, upper fluid coupling termination means for coupling (a) the interstitial space within said outer secondary containment/vapor return pipeline to the nozzle vapor return means and (b) the fuel delivery pipeline to the fuel dispenser nozzle, lower fluid coupling termination means for coupling (a) the interstitial space within said outer secondary containment/vapor return pipeline to the first, vapor return opening in a wall of the underground storage tank and (b) the fuel delivery pipeline to the second, fuel outlet opening in a wall of the underground storage tank whereby a continuous uninterrupted, vapor return space or path, in addition to secondary containment, is established in and by said secondary containment/vapor return pipeline, between said upper and lower fluid coupling termination means and around or about said fuel delivery pipeline, sensing means for sensing fuel mounted to a lower side of the outer secondary containment/vapor return pipeline adjacent said lower fluid coupling termination means, annunciator means, for providing an audible alarm when fuel is sensed in said outer secondary containment/vapor return pipeline, being located at the fuel service station, and conductor means for coupling said sensing means to said annunciator means being connected between said sensing means and said annunciator means.

4. An underground secondary containment and simultaneous vapor return piping system for use at a fuel service station which includes a fuel dispensing including a fuel dispensing nozzle and nozzle vapor return means at a dispensing island, an underground fuel storage tank having a first, vapor return opening in a wall of the tank and a second, fuel outlet opening in a wall of the tank, and a primary fuel delivery pipeline having a given diameter and extending between the underground storage tank and the fuel dispenser, said secondary containment and simultaneous vapor return piping system comprising an outer, underground, sealed, larger diameter, secondary containment/vapor return pipeline extending around and axially with the inner, primary fuel delivery pipeline from the underground storage tank to the fuel dispenser to establish secondary containment for said fuel delivery pipeline and simultaneously to establish within the secondary containment/vapor return pipeline and around or about said fuel delivery pipeline, a continuous, uninterrupted, axially extending, interstitial space defining a vapor return path, upper fluid coupling termination means for coupling (a) the interstitial space within said outer secondary containment/vapor return pipeline to the nozzle vapor return means and (b) the fuel delivery pipeline to the fuel dispenser nozzle, and lower fluid coupling termination means for coupling (a) the interstitial space within said outer secondary containment/vapor return pipeline to the first, vapor return opening in a wall of the underground storage tank and (b) the fuel delivery pipeline to the second, fuel outlet opening in a wall of the underground storage tank whereby a continuous uninterrupted, vapor return space or path, in addition to secondary containment, is established in and by said secondary containment/vapor return pipeline, between said upper and lower fluid coupling termination means and around or about said fuel delivery pipeline, said lower fluid coupling termination means including valve means for preventing fuel from entering said secondary containment/vapor return pipeline from the underground storage tank and said primary fuel delivery pipeline together with said secondary containment/vapor return pipeline being arranged to slope downwardly at a selected slope angle from the dispensing island to the underground storage tank.

5. The system of claim 4 wherein said upper termination means includes a tee in the outer secondary containment/vapor return pipeline, a reducer extending from one end of the tee to and sealed against the inner fuel delivery pipeline, a pipe section extending from a side port of said tee, and a reducer extending between said pipe section to a vapor conduit of the vapor return means associated with the dispenser nozzle.

6. The system of claim 4 wherein said upper termination means includes a tee in the outer pipeline, about an elbow in the fuel delivery pipeline, the fuel delivery pipeline including a pipe section extending from the elbow through a side port of said tee, a reducer extending from the side port of said tee to and sealed against the pipe section of the fuel delivery pipeline which extends to and through a fire blocking valve at the fuel dispensing island, and said upper termination means further including larger diameter pipe sections connected to the outer end of said tee disposed about the elbow in the fuel delivery pipeline to a reducer which extends to a fire prevention valve coupled to a vapor return conduit of the vapor return means associated with the dispensing nozzle.

* * * * *

UNITED STATES PATENT AND TRADEMARK OFFICE

CERTIFICATE OF CORRECTION

PATENT NO. : 5,301,721

DATED : April 12, 1994

INVENTOR(S) : John P. Hartmann

It is certified that error appears in the above-indentified patent and that said Letters Patent is hereby corrected as shown below:

Column 9, line 24, "dispenser secondary" should be --dispenser to establish secondary--.

Signed and Sealed this

Eighth Day of November, 1994

*Attest:*

*Attesting Officer*

BRUCE LEHMAN

*Commissioner of Patents and Trademarks*